US006971380B2

(12) United States Patent
Mills et al.

(10) Patent No.: US 6,971,380 B2
(45) Date of Patent: Dec. 6, 2005

(54) CYLINDRICAL CATALYTIC HEATER

(75) Inventors: Donovan Dale Mills, Stillwater, OK (US); Justin Vandrew Radford, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 10/791,588

(22) Filed: Mar. 2, 2004

(65) Prior Publication Data

US 2005/0196719 A1 Sep. 8, 2005

(51) Int. Cl.[7] ..... F24C 3/04

(52) U.S. Cl. ..... 126/92 B; 126/92 AC; 431/328

(58) Field of Search ..... 126/92 R, 92 A, 126/97, 92 B, 96, 92 AC, 85 R, 58; 431/344, 431/328, 329

(56) References Cited

U.S. PATENT DOCUMENTS

| | | | | |
|---|---|---|---|---|
| 1,455,551 | A * | 5/1923 | Ryan | 126/58 |
| 1,456,725 | A | 5/1923 | Fehrenbach | |
| 1,473,844 | A | 11/1923 | Garbarini | |
| 1,506,964 | A | 9/1924 | Antrim | |
| 1,713,827 | A | 5/1929 | Hanson | |
| 1,935,845 | A * | 11/1933 | Hader | 126/92 B |
| 2,170,735 | A * | 8/1939 | Spikes | 126/58 |
| 3,310,047 | A | 3/1967 | Budden | |
| 3,731,668 | A | 5/1973 | Smith | |
| 4,319,125 | A | 3/1982 | Prince | |
| 4,357,929 | A | 11/1982 | Johnson | |
| 4,569,329 | A | 2/1986 | Cherryholmes | |
| 4,782,814 | A | 11/1988 | Cherryholmes | |
| D429,803 | S | 8/2000 | Schmidt | |
| 6,213,761 | B1 | 4/2001 | Schmidt | |
| D457,615 | S | 5/2002 | Schmidt et al. | |
| 6,397,835 | B1 * | 6/2002 | Liang | 126/92 B |
| 6,470,876 | B1 | 10/2002 | Schmidt et al. | |
| 6,470,877 | B1 | 10/2002 | Waters | |
| 6,651,647 | B2 | 11/2003 | Waters | |
| 2001/0037804 | A1 | 11/2001 | Waters et al. | |

FOREIGN PATENT DOCUMENTS

| | | | | |
|---|---|---|---|---|
| FR | 599295 | * | 1/1926 | 126/92 B |
| GB | 403490 | * | 12/1933 | 126/92 B |
| GB | 1602196 | * | 11/1981 | |
| JP | 60-178226 A | * | 9/1985 | |

* cited by examiner

*Primary Examiner*—Alfred Basichas
(74) *Attorney, Agent, or Firm*—Leydig, Voit & Mayer, Ltd.

(57) ABSTRACT

A catalytic heater with a cylindrical combustion chamber. The catalytic heater may be positioned centrally to provide heat for a number of people or an area. A reflective top is movable to along a side of the cylindrical combustion chamber for directing the heat in a desired direction. The cylindrical catalytic heater is capable of providing heat in all directions simultaneously; i.e., in a 360 degree pattern. The movable reflector permits the heat to be directed in a desired direction, providing much flexibility for the cylindrical catalytic heater.

12 Claims, 4 Drawing Sheets

CYLINDRICAL CATALYTIC HEATER

TECHNICAL FIELD OF THE INVENTION

The present invention relates generally to heating devices, and more particularly to catalytic heaters.

BACKGROUND OF THE INVENTION

A typical catalytic combustion apparatus oxidizes a gaseous fuel, such as methane, butane, or propane, at room temperature to generate heat. Generally, the fuel is introduced into a gas-tight housing where the fuel expands to completely fill the housing. As the fuel diffuses through a catalyst-containing support located at an outlet of the housing, ambient air mixes with the diffused fuel. The fuel-air mixture is then oxidized by a reaction promoted by the catalyst to produce heat. Such catalysts typically include noble metals such as platinum group metals or compounds containing the same. The substrates upon which the catalysts are supported are typically made from glass fibers, porous metals, or ceramics such as ceramic wool or ceramic board and the like.

The products of the catalyst-enhanced oxidation reaction, such as carbon dioxide and water vapor, are discharged through the outside surface of the catalyst-containing substrate. Convection currents disperse the reaction products and draw in ambient air to provide oxygen to sustain the reaction. The reaction is normally started by igniting the reactants, by means of a flame (e.g. a pilot light) or a spark induced, for example, by an electrical ignition.

The assignee of the present invention has developed a number of different catalytic heaters, examples being shown in U.S. Pat. Nos. 6,213,761; 6,470,876; Des. 429,803; and Des. 457,615. Each of these patents discloses a catalytic heater having a round disc from which heat is radiated. The heat is radiated in a single direction. While the prior art catalytic heaters work well for their intended purpose, because they are directed in a single direction, they cannot be positioned centrally to provide heat for a number of people.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with an embodiment, a catalytic heater is provided that includes a cylindrical combustion chamber. The cylindrical catalytic heater is of a tabletop variety, and may be positioned centrally to provide heat for a number of people or an area.

In accordance with an embodiment, a top for the cylindrical catalytic heater is movable to along a side of the cylindrical combustion chamber of the catalytic heater for directing the heat in a desired direction. A movable heat reflector may be provided in another manner, and may be attached at other locations on the cylindrical catalytic heater, such as at the bottom of the cylindrical catalytic heater.

The cylindrical catalytic heater is capable of providing heat in all directions simultaneously; i.e., in a 360 degree pattern. In addition, the movable reflector permits the heat to be directed in a desired direction, providing much flexibility for the cylindrical catalytic heater.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
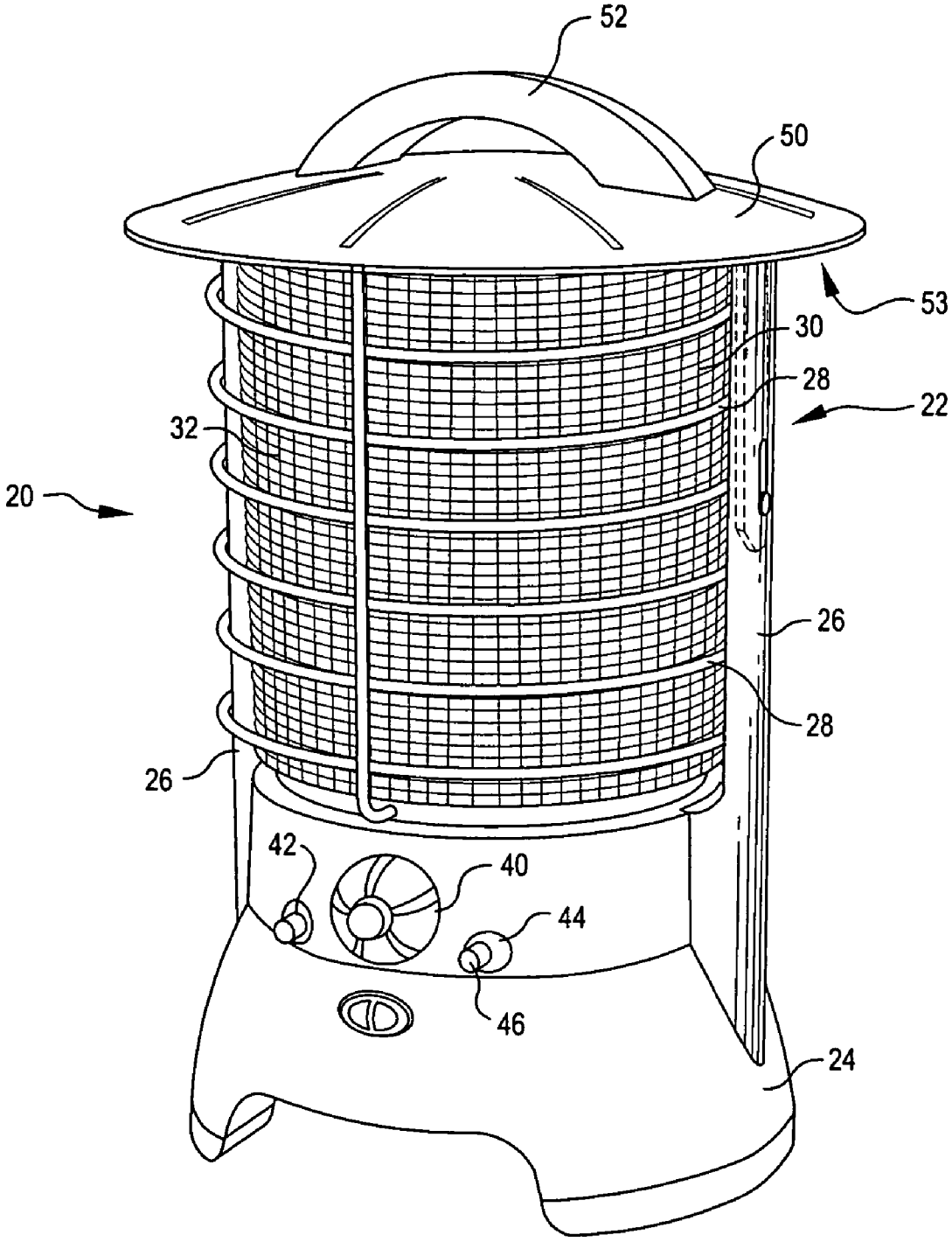
FIG. 1 is a side perspective view of a cylindrical catalytic heater in accordance with an embodiment of the present invention.

Referring now to the drawings, in which like reference numerals represent like parts throughout the several views, FIG. 1 shows a cylindrical catalytic heater 20 in accordance with an embodiment. The cylindrical catalytic heater 20 includes a housing 22 having a base 24. Two side rails 26 extend upward from the base 24. A protective grid 28 is attached to the side rails 26 and extends around a combustion chamber 30 for the cylindrical catalytic heater 20.

The components of a catalytic combustion chamber, such as the combustion chamber 30, are known in the art, and only moderate detail is given here for the benefit of the reader. However, in accordance with an embodiment, unlike prior art catalytic combustion chambers, the combustion chamber 30 is formed in the shape of a cylinder. The cylinder is positioned so that its central axis is aligned vertically, permitting heat from the combustion chamber to emanate mostly horizontally.

The cylindrical catalytic heater 20 is tabletop size, in that it can be placed on a table top for use. In addition, the cylindrical catalytic heater 20 is fully portable by most users with a single hand. The cylindrical catalytic heater 20 may be approximately 10 to 40 inches in height, although other sizes may be used, and aspects of the present invention may be used on other sized heaters.

The combustion chamber 30 includes a gas permeable head screen 32 extending therearound, and a catalyst (not shown) therein. As is known, the catalyst is typically a woven fabric-like ceramic pad composed of materials such as aluminum silicone, zirconia, titania, silica, and alumina, and mixtures of these materials, that is porous for facilitating gas diffusion and refractory for resisting the heat accompanying combustion. The catalyst further includes a catalyst material composed of a noble metal, such as platinum, and compounds of these, which facilitates the oxidation of the fuel-air mixture to generate a flameless combustion.

The cylindrical catalytic heater 20 shown in the drawings is designed to be used with a propane cylinder 34 (FIG. 2), but other fuel sources may be utilized. Fuel may be provided, for example, by a kerosene tank, or other fuel source. Other gaseous fuels may be used, such as, for example, methane, ethane, propane and butanes, and olefines such as propylene and butenes and mixtures thereof. Commercially available fuels, such as natural gas, town gas, liquefied natural gas, liquefied petroleum gases and various waste hydrocarbon gases are suitable as well, including mixtures thereof. In addition, vaporizable liquid hydrocarbon fuels (i.e., liquid fuels which may be formed in fine droplets) such as kerosene may be used. Permanent gas fuels may also be used, such as hydrogen, which may be diluted with an inner gas such as nitrogen to control the temperature of combustion.

A conduit 36 leads from the propane cylinder 34 to a regulator 38, where the pressure is dropped to a usable level. Gas then flows from the regulator 38 via another conduit 39, which distributes the gas throughout the catalyst. In accordance with an embodiment, the cylindrical catalytic heater 20 produces approximately 15,000 to 20,000 British thermal units (BTU's), but different outputs may be provided.

Suitable controls may be provided for operating the cylindrical catalytic heater 20. These controls may be used to light and control fuel flow to the combustion chamber 30. In the embodiment shown in FIG. 1, a temperature control knob 40 is provided for controlling the flow of fuel to the combustion chamber 30 in a manner known in the art. An electronic starter 42 is used to ignite gas. A thermoelectric valve 44 may also be included. As is known, thermoelectric valves include a manual button 46 (shown on the outer portion of the base 24) for opening a valve and allowing gas to flow therethrough, and an electronic device, such as an electromagnet, for holding the valve open. The electronic device is connected to a heat sensor (not shown), such as a thermocouple, which is connected to the combustion chamber 30. When the thermocouple is heated, it provides a voltage to the electronic device to hold the thermoelectric valve 44 open. In practice, a user holds the manual button 46 after igniting the combustion chamber 30 (e.g., using the electronic starter 42) and holds the manual button 46 in place until the combustion chamber 30 is heated to a temperature at which sufficient heat is provided for the thermocouple to provide voltage to the electronic device, thereby causing the electronic device to hold the thermoelectric valve 44 open.

The thermoelectric valve 44 serves as a safety feature so that when a flame for the combustion chamber 30 is extinguished, the loss of heat to the combustion chamber 30 and therefore the thermocouple causes the fuel flow to the combustion chamber 30 to stop. Other safety devices may be incorporated.

If desired, a fan (not shown) may be provided for directing heat in one or more desired directions. An example of such a fan is shown in U.S. Pat. No. 6,470,876. The fan may be powered by batteries, thermoelectric modules, solar panels, an AC transformer, or another suitable source.

The combustion chamber 30, because it is shaped like a cylinder, emanates heat in all directions, e.g., at 360 degrees horizontally relative to the housing 22. Thus, the cylindrical catalytic heater 20 may be used as a portable space heater for a variety of locations, including tents, homes, factories, caravans, hatcheries, greenhouses, drying rooms, and the like. The cylindrical catalytic heater 20, because it emanates heat in all directions, is particularly well suited for a party environment where people gather around a central location, such as a table. The cylindrical catalytic heater 20 may thus be centered in the middle of the table, and provides heat for all people sitting around the table.

In accordance with an embodiment, the cylindrical catalytic heater 20 includes a top reflector 50. In a normal, first position, shown in FIG. 1, the top reflector 50 is situated over the combustion chamber 30 and the protective grid 28 and abuts against the top of the side rails 26. The top reflector 50 includes a handle 52 centered thereon, permitting a user to lift the cylindrical catalytic heater 20, and to place the cylindrical catalytic heater 20 in a desired location.

Figure 2:
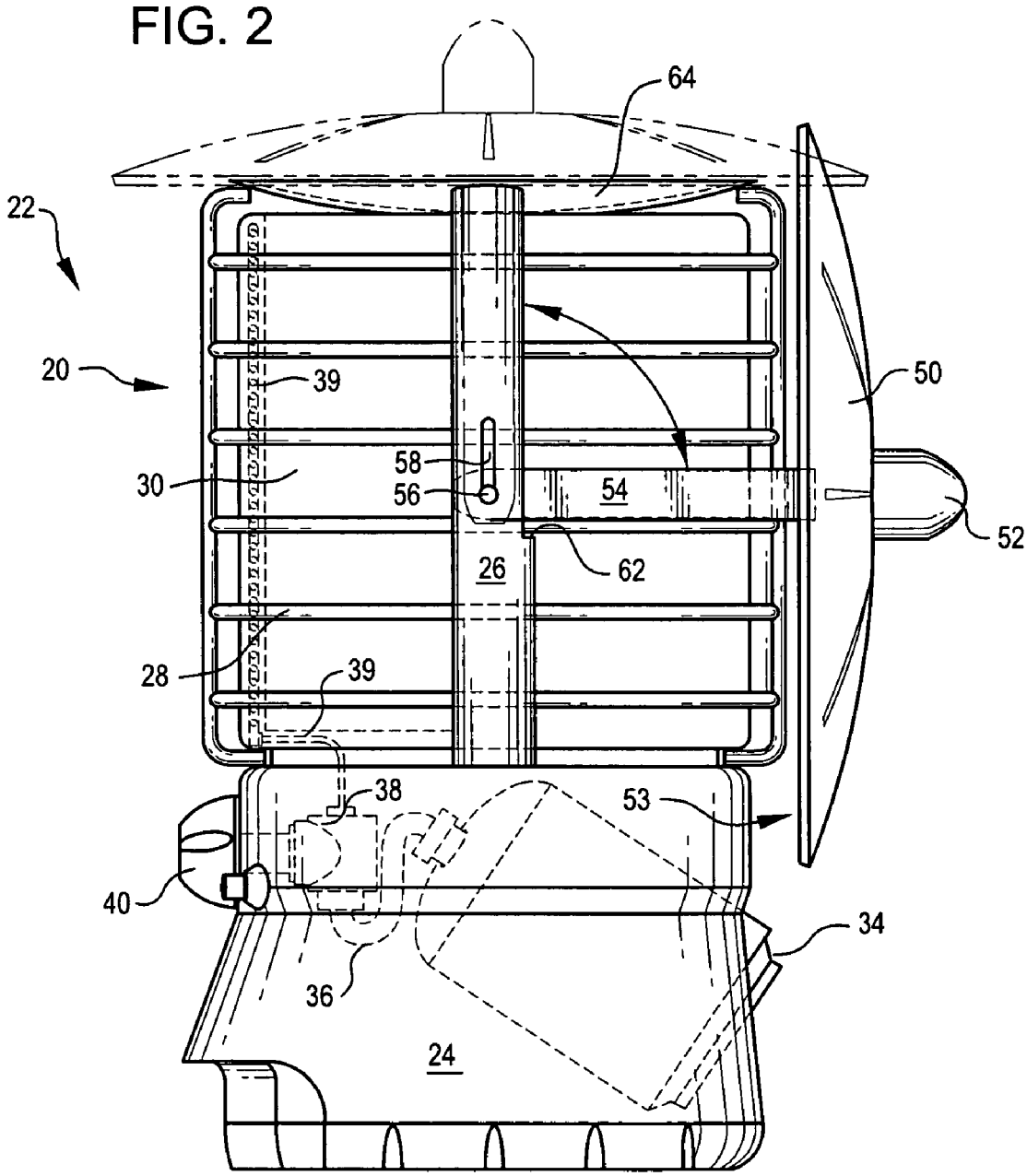
FIG. 2 is a side view of the cylindrical catalytic heater of FIG. 1, with a movable top reflector translated to a downward position.

In accordance with an embodiment, the top reflector 50 is rotatable downward, for example, to the second, reflector position shown in FIG. 2, so that an inner reflective surface 53 of the top reflector 50 may direct heat in a desired vertical or diagonal direction.

Figure 3:
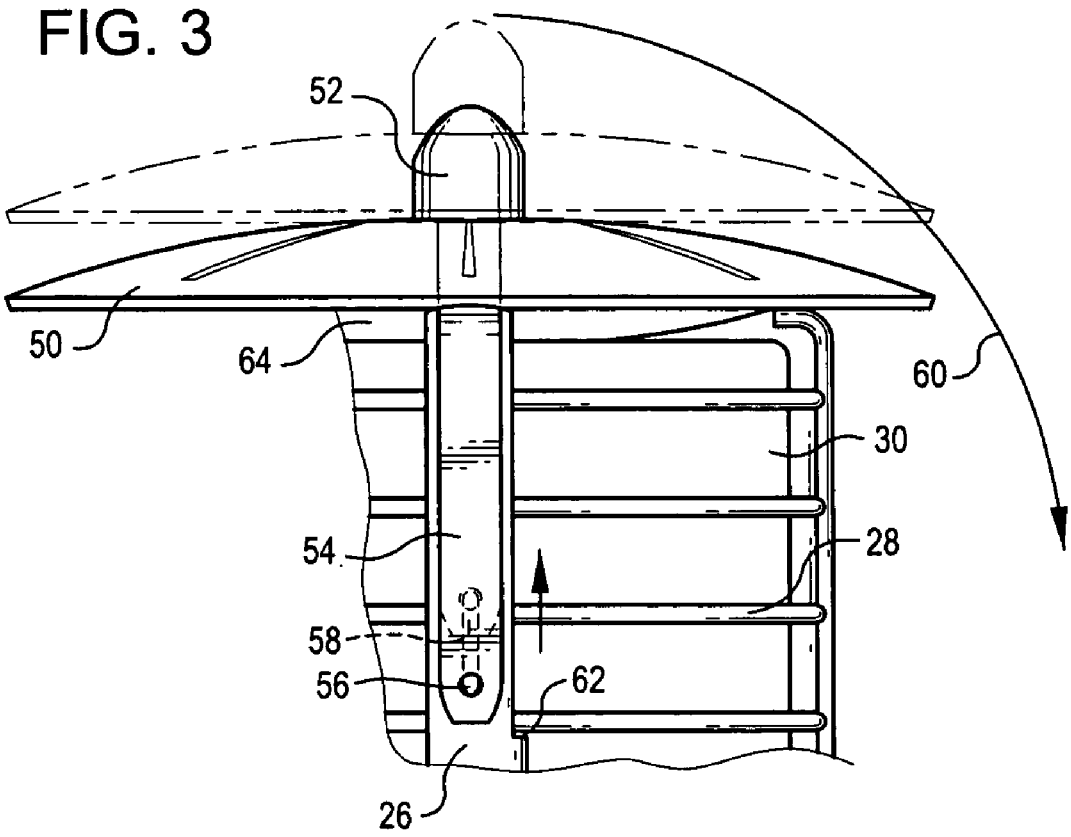
FIG. 3 is a partial cut-away side view of the cylindrical catalytic heater of FIG. 1, similar to FIG. 2, showing a beginning of the translating movement of the top reflector.

In the embodiment shown in the figures, the top reflector 50 includes side rails 54 extending down from outer edges thereof. Each of the side rails 54 includes a pin 56 that is received in a slot 58 on the side rails 26 of the housing 22. In the normal position when the top reflector 50 is positioned over the combustion chamber 30, the pins 56 are located at the bottom of the slots 58, such as is shown in FIG. 1. The pins 56 may be releasably locked in this location, and may be released, for example, by pushing the pins 56 inward or by otherwise releasing the temporary locked position of the pins 56 relative to the slots 58. After releasing the pins 56, the top reflector 50 may be lifted upward, for example by the handle 52, to the position shown in phantom in FIG. 3. The top reflector 50 may then be rotated downward following the arrow 60 in FIG. 3 to the position in FIG. 2. During this movement, the pins 56 may move downward in the slots 58 so that the top reflector 50 ultimately ends up in the location shown in FIG. 2.

The inner reflective surface 53 radiates heat that is directed from the combustion chamber 30 to the right in FIG. 2 and reflects that heat to the left. Thus, heat emanating from the combustion chamber 30 is directed or focused to the left in FIG. 2. The cylindrical catalytic heater 20 may be used in this fashion, for example, when the cylindrical catalytic heater 20 is placed against a wall or is otherwise used so that heat is desired primarily in one direction. The top reflector 50 may be otherwise configured, for example in an arc, so that the heat may be even more focused. In addition, a reflector may move from different positions, such as from underneath the cylindrical catalytic heater 20, so as to provide selective focusing of the heat from the cylindrical catalytic heater 20.

The movable reflector of the present invention may be utilized with catalytic heaters having a variety of configurations, and is not limited to the cylindrical embodiment described.

An abutment 62 is provided on each side rail 26 for limiting rotation of the top reflector 50 relative to the housing 22 of the cylindrical catalytic heater 20. The abutments 62 are positioned so that they are engaged by the side rails 54 when the top reflector 50 is rotated to the position shown in FIG. 2. Another type of abutment or stop may be used for preventing over-rotation of the top reflector 50.

A top plate 64 may be positioned over the combustion chamber 30 so that when the top reflector 50 is moved to the side position, the inner portions of the combustion chamber 30 are not exposed. This top plate 64 may also act as a heat sink to prevent the top reflector 50 from being too hot for handling during operation.

Figure 4:
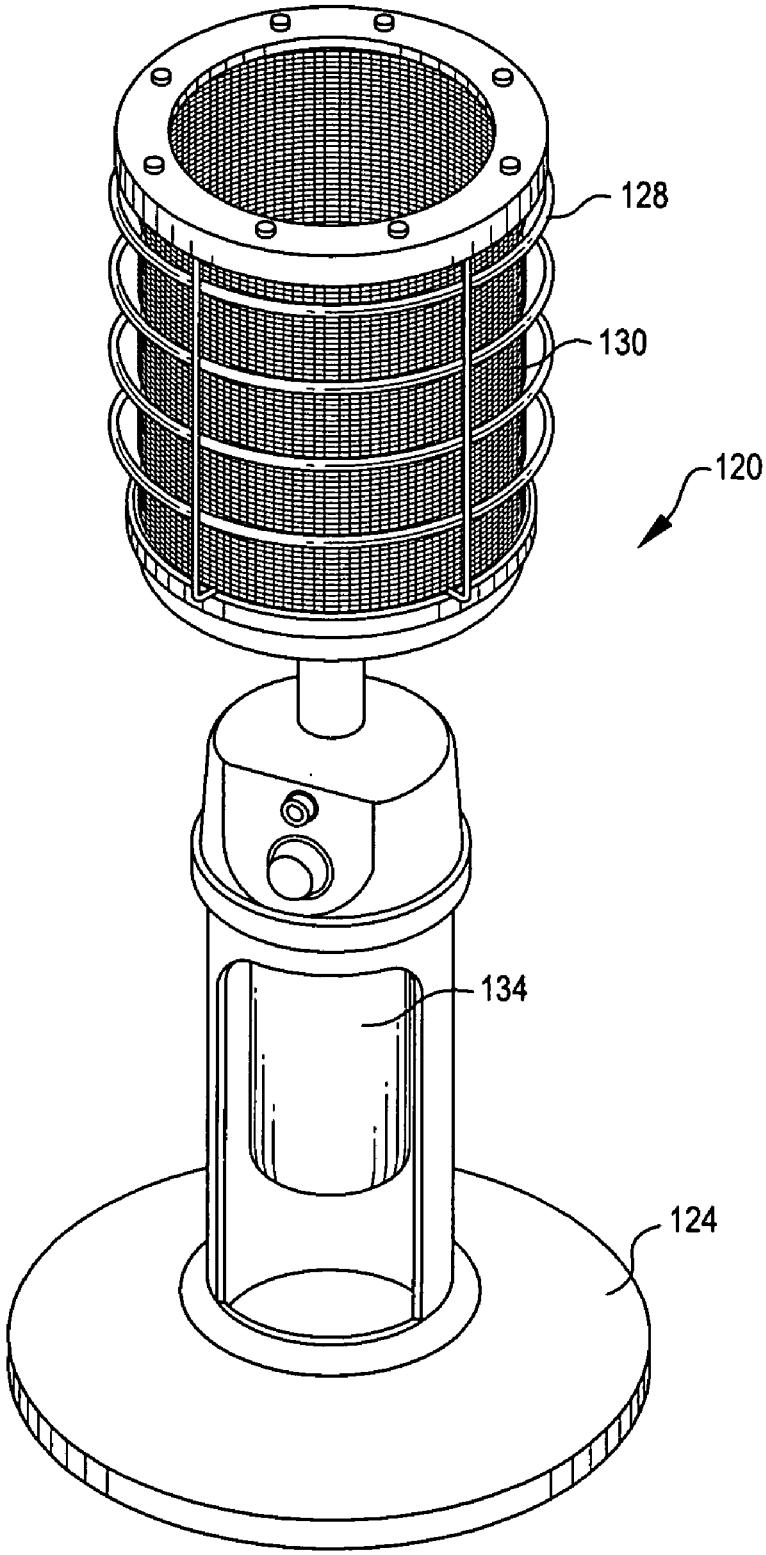
FIG. 4 is an alternate embodiment of a cylindrical catalytic heater.

An alternate, simplified embodiment of a cylindrical catalytic heater 120 is shown in FIG. 4. This cylindrical catalytic heater 120 includes a base 124 and a combustion chamber 130 mounted directly above a propane cylinder 134. The combustion chamber 130 includes a protective grid 128, similar to the protective grid 28. Although not shown in the drawing, a protective top may be provided for the cylindrical catalytic heater 120.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A catalytic heater, comprising:

a combustion chamber that emanates heat horizontally; and a reflector connected to the catalytic heater and movable between a first position and a second position adjacent the combustion chamber, the reflector being arranged in the second position along one side of the combustion chamber so as to direct heat emanating from the combustion chamber towards an opposite side of the combustion chamber and in a direction that is more horizontal than vertical and the reflector being positioned above the combustion chamber when in the first position.

2. The catalytic heater of claim 1, wherein the reflector serves as a top for the combustion chamber when in the first position.

3. The catalytic heater of claim 2, wherein the reflector includes a handle for lifting the catalytic heater.

4. The catalytic heater of claim 3, further comprising a heat shield between the reflector in the first position and the combustion chamber.

5. The catalytic heater of claim 2, further comprising a heat shield between the reflector in the first position and the combustion chamber.

6. The catalytic heater of claim 1, wherein the combustion chamber is shaped in a cylinder.

7. The catalytic heater of claim 6, wherein the cylinder is arranged with a central axis extending substantially vertical.

8. A catalytic heater, comprising:

a combustion chamber shaped in a cylinder and arranged with a central axis extending substantially vertical; and a reflector connected to the catalytic heater and movable between a first position and a second position adjacent the combustion chamber, the reflector being arranged in the second position along one side of the combustion chamber so as to direct heat emanating from the combustion chamber towards an opposite side of the combustion chamber and in a direction that is more horizontal than vertical and the reflector being positioned above the combustion chamber when in the first position.

9. The catalytic heater of claim 8, wherein the reflector serves as a top for the combustion chamber when in the first position.

10. The catalytic heater of claim 9, wherein the reflector includes a handle for lifting the catalytic heater.

11. The catalytic heater of claim 10, further comprising a heat shield between the reflector in the first position and the combustion chamber.

12. The catalytic heater of claim 8, further comprising a heat shield between the reflector in the first position and the combustion chamber.

* * * * *